US007162989B2

(12) United States Patent
Arakawa

(10) Patent No.: US 7,162,989 B2
(45) Date of Patent: Jan. 16, 2007

(54) ENGINE UNIT OF MOTORCYCLE

(75) Inventor: Hidetoshi Arakawa, Iwata-Gun (JP)

(73) Assignee: Suzuki Kabushiki Kaisha, Hamamatsu (JP)

( * ) Notice: Subject to any disclaimer, the term of this patent is extended or adjusted under 35 U.S.C. 154(b) by 217 days.

(21) Appl. No.: 10/869,958

(22) Filed: Jun. 18, 2004

(65) Prior Publication Data

US 2004/0255897 A1 Dec. 23, 2004

(30) Foreign Application Priority Data

Jun. 18, 2003 (JP) ..... 2003-173830

(51) Int. Cl.
*F02B 75/06* (2006.01)

(52) U.S. Cl. ..... 123/192.1; 123/195 A; 123/198 R; 192/70.17; 74/329

(58) Field of Classification Search ..... 123/198 R, 123/192.1, 195 A; 74/329, 409, 410, 411; 192/70.17, 89.26, 212
See application file for complete search history.

(56) References Cited

U.S. PATENT DOCUMENTS 5,063,897 A * 11/1991 Okui et al. ..... 123/198 R

* cited by examiner

*Primary Examiner*—Tony M. Argenbright
*Assistant Examiner*—Katrina Harris
(74) *Attorney, Agent, or Firm*—Oblon, Spivak, McClelland, Maier & Neustadt, P.C.

(57) ABSTRACT

An engine unit for an motorcycle is disclosed in which an accessory drive gear is disposed downstream of primary dampers in the engine power transmission path, and simultaneously upstream of a clutch mechanism in the engine power transmission path. In this engine unit, an accessory, for example, generator, is connected to an intermediate shaft that is parallel to a crank shaft and a counter shaft so as to rotate integrally with the intermediate shaft. An accessory driven gear is meshed with the accessory drive gear, and an accessory damper is disposed between the intermediate shaft and the accessory for absorbing rotational shocks. Furthermore, a starter motor is gear-engaged with the intermediate shaft via a one-way clutch, and the position of this gear engagement is provided between the accessory damper and the accessory driven gear.

6 Claims, 5 Drawing Sheets

ENGINE UNIT OF MOTORCYCLE

BACKGROUND OF THE INVENTION

1. Field of the Invention

The present invention relates to an engine unit of a motorcycle, which includes a transmission, a clutch mechanism, a starter motor, and accessories or auxiliary equipments such as a generator and the like.

2. Related Art

Regarding an engine unit of a motorcycle, for example, Japanese Patent No. 2841649 discloses an engine unit including: a crank shaft and a counter shaft, which are journaled in parallel with each other in an engine case; a primary drive gear mounted on the crank shaft; a primary driven gear mounted on the counter shaft and meshed with the primary drive gear; primary dampers provided to the primary driven gear for absorbing rotational shocks; a clutch mechanism provided to the primary driven gear for transmitting and interrupting the rotation of the primary driven gear with respect to the counter shaft; and an accessory drive gear disposed juxtaposedly with the primary driven gear which drives an accessory and through which the driving force of a starter motor is transmitted to the crank shaft.

As mentioned, by providing the primary dampers to the primary driven gear , it makes possible to absorb torque variations (rotational shocks) of the crank shaft at the startup of the engine by the primary dampers and to prevent the rotational shocks from being transmitted to the counter shaft and the downstream side thereof in the power transmission path. This leads to an improvement in the ride comfort of a motorcycle and a reduction in gear noises due to backlashes between gears, i.e., an improvement in quietness.

However, in the arrangements of the conventional structure mentioned above, since the accessory drive gear disposed juxtaposedly, i.e., in parallel, with the primary driven gear is rotated integrally with the primary driven gear, the accessory drive gear is disposed upstream of the primary dampers in the engine power transmission path. As a result, rotational shocks due to the torque variations and the like are transmitted to the accessory side through the accessory drive gear just as they are. This might have a detrimental effect on the durability of accessory members or auxiliary equipments (called herein as "accessory" or "accessories") and might cause gear noises due to backlashes-of a gear train including the accessory drive gear, as well as gear noises during the operation of a starter motor.

SUMMARY OF THE INVENTION

Accordingly, it is an object of the present invention to provide an engine unit of a motorcycle which is capable of reducing gear noises due to backlashes of the gear train including an accessory drive gear and capable of increasing the durability of accessories and the like, which allows its startup performance, maintainability, and lateral weight balance to be improved.

This and other objects can be achieved according to the present invention by providing an engine unit of a motorcycle including a crank shaft and a counter shaft which are journaled in parallel with each other; a primary drive gear provided on the crank shaft; a primary driven gear provided on the counter shaft so as to be meshed with the primary drive gear; primary dampers provided to the primary driven gear for absorbing rotational shocks; a clutch mechanism provided to the primary driven gear for transmitting rotation of the primary driven gear to the counter shaft and interrupting the rotation therefrom; and an accessory drive gear which is disposed juxtaposedly with the primary driven gear for driving an accessory and through which the driving force of a starter motor is transmitted to the crank shaft, wherein the accessory drive gear is disposed on the downstream side of the primary dampers in the engine power transmission path.

According to the structure mentioned above, a buffering effect produced by the primary dampers interposed between the crank shaft, and the accessory and starter motor can reduce the gear noises due to backlashes of the gear train including the accessory drive gear and can increase the durability of accessories and the like.

In a preferred embodiment of the present invention in the above aspect, it is preferable that the accessory drive gear is disposed on the upstream side of the clutch mechanism in the engine power transmission path. This makes it possible to reduce the rotational inertia mass and improve the startup performance the engine by disengaging the clutch connection at the startup of the engine.

Furthermore, it is also preferable that this engine unit further includes: an intermediate shaft disposed in parallel with the crank shaft and the counter shaft, in which the accessory is connected to the intermediate shaft so as to be rotatable integrally therewith; an accessory driven gear meshed with an accessory drive gear; and an accessory damper provided between the intermediate shaft and the accessory for absorbing rotational shocks. Herein, the starter motor is preferably gear-engaged with the intermediate shaft via a one-way clutch, and the gear engagement is preferably made at a position between the accessory damper and the accessory driven gear.

According to such arrangements, the accessory damper is protected by the primary damper against torque variations of the crank shaft, and in addition, the accessory is driven through the intermediary of the accessory damper at the startup of the engine. This reduces noises of the accessory and increases the durability thereof.

Furthermore, it is preferable that the accessory damper be disposed so as to face the connection portion between the intermediate shaft and the accessory. This facilitates the replacement of the accessory damper and improves the maintainability.

In addition, it is also preferable that the clutch mechanism is disposed further outside of the primary driven gear in the width direction of the motorcycle, and the accessory drive gear is disposed further inside of the primary driven gear in the width direction of the motorcycle.

According to such arrangement, since the meshing position between the accessory drive gear and the accessory driven gear becomes closer to the center side of the engine in the width direction of the motorcycle, the installation positions of accessory such as generator, starter motor, and the like also become closer to the center side in the width direction of the motorcycle. This allows the lateral weight balance of the engine unit to be easily adjusted.

The nature and futher characteristic features of the present invention will be made more clear from the following descriptions made with reference to the accompanying drawings.

DESCRIPTION OF THE PREFERRED EMBODIMENTS

Figure 1:
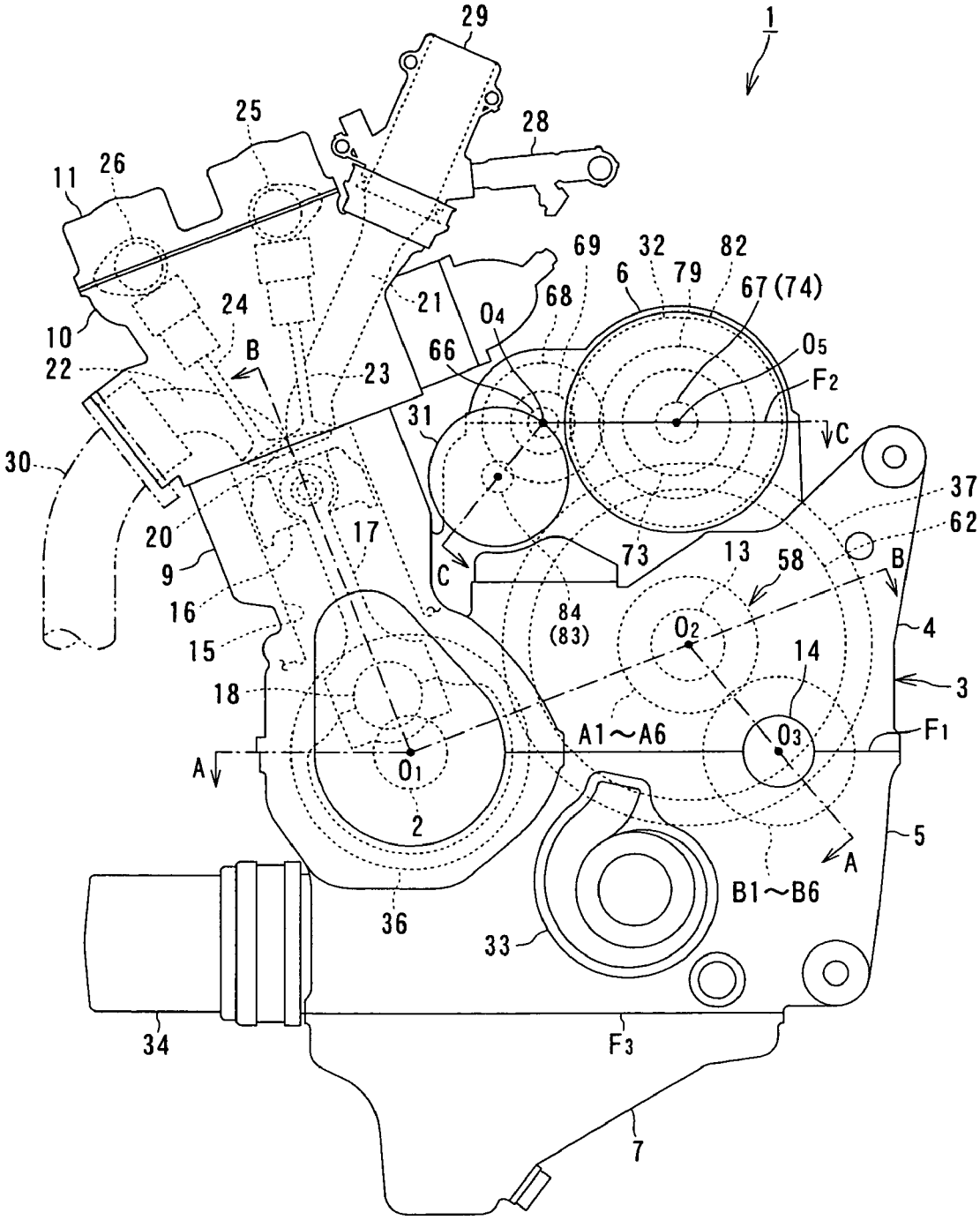
FIG. 1 is an illustrated left side view of an engine unit of a motorcycle according to an embodiment of the present invention.

A preferred embodiment according to the present invention will be described hereunder with reference to the accompanying drawings.

With reference to FIGS. 1 to 4, this engine unit 1 is, for example, an in-line four-cylinder DOHC (double overhead camshaft) engine including a crank shaft 2 extending along the width direction of the motorcycle. An engine case 3 of the engine unit 1 has a horizontal quadripartite structure in which an upper case 4 and lower case 5 are joined on a horizontal joint surface $F_1$ , the upper case 4 and a top cover 6 are joined on a horizontal joint surface $F_2$, and the lower case 5 and an oil pan 7 are joined on a horizontal joint surface $F_3$. Further, on the front top surface of the upper case 4, a cylinder block 9 is integrally formed, a cylinder 10 and head cover 11 are placed on the top surface of the cylinder block 9.

In the engine case 3, a crank shaft 2, a counter shaft 13 and a drive shaft 14 are journaled in parallel with each other. Pistons 16 slidably are inserted respectively into the four cylinder bores (merely, cylinders) 15 formed within a cylinder block 9 and operatively connected to crank pins 18, respectively, of the crank shaft 2 through connecting rods 17, to thereby convert the sliding motion of each of the pistons 16 into a rotational motion of the crank shaft 2.

Combustion chambers 20 are formed on the lower surface portions of the cylinder head 10 so as to be matched with the cylinder bores 15, respectively. Furthermore, an intake port 21 and an exhaust port 22 are also formed in the rear surface and the front surface of each of the combustion chamber 20. The intake port 21 and the exhaust port 22 are opened/closed with respect to the combustion chamber 20 in association with the operations of an intake valve 23 and an exhaust valve 24. The intake valve 23 and the exhaust valve 24 are driven to open/close at a predetermined timing through an intake cam shaft 25 and an exhaust cam shaft 26, respectively.

A throttle body 29 having a fuel injection device 28 is connected to the outside portion of the intake port 21, and an exhaust pipe 30 is connected to the outside portion of the exhaust port 22.

Furthermore, a starter motor 31 and a generator 32 as one example of an accessory (i.e., auxiliary component of the engine are disposed on the top surface of the upper case 4 and at the rear of the cylinder block 9. A water pump installation section 33 is also disposed on the left side surface of the lower case 5, and an oil filter case 34 is disposed on the front surface of the lower case 5.

On the outer peripheral surface of the third crank web 35 from the right of the crank shaft 2, a primary drive gear 36 is formed so as to rotate integrally with the third crank web 35. This primary drive gear 36 is meshed with a primary driven gear 37 provided on the counter shaft 13.

Figure 3:
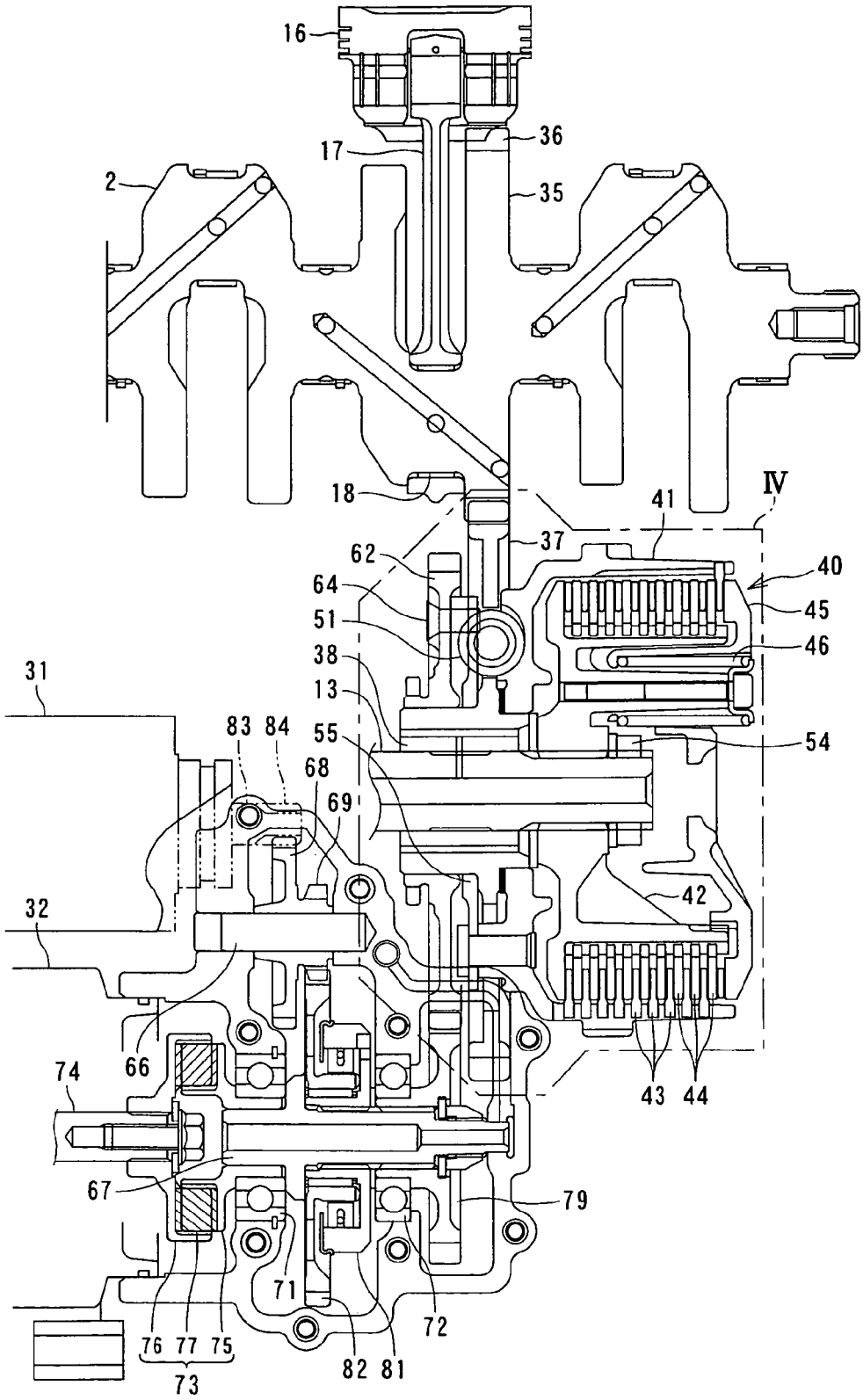
FIG. 3 is a sectional view of the engine unit of FIG. 1, in which the section taken along the line B-$O_1$-$O_2$-B and the section taken along the line C-$O_4$-$O_5$-C each shown in FIG. 1 are combined.
Figure 4:
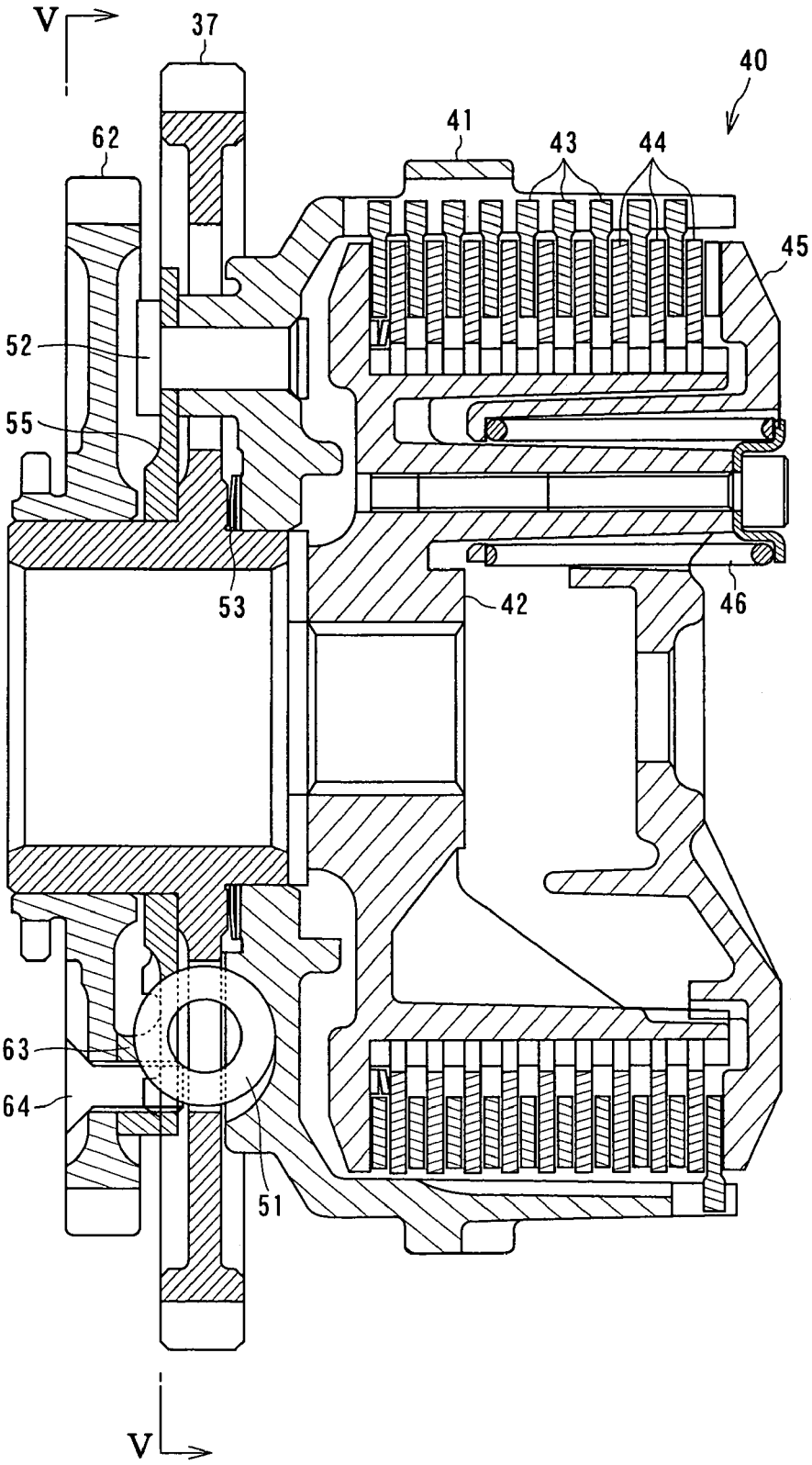
FIG. 4 is an enlarged view of the IV part in FIG. 3.

As shown in FIGS. 3 and 4, a primary driven gear 37 is mounted to the counter shaft 13 at a portion situated somewhat to the right so as to be rotatable via a bearing 38, and a clutch mechanism 40 is disposed further toward the outside than the primary driven gear 37 in the width direction of the motorcycle (i.e., toward the right side of the primary driven gear 37 in FIGS. 3 and 4).

The clutch mechanism 40 is a multi-plate clutch for a motorcycle, which is commonly known, and comprises a clutch housing 41, a clutch hub 42, a plurality of drive plates 43, a plurality of driven plates 44, a pressure plate 45, a clutch spring 46, a clutch release piece 47, a clutch release bar 48, a clutch release rod 49, and the like.

Figure 5:
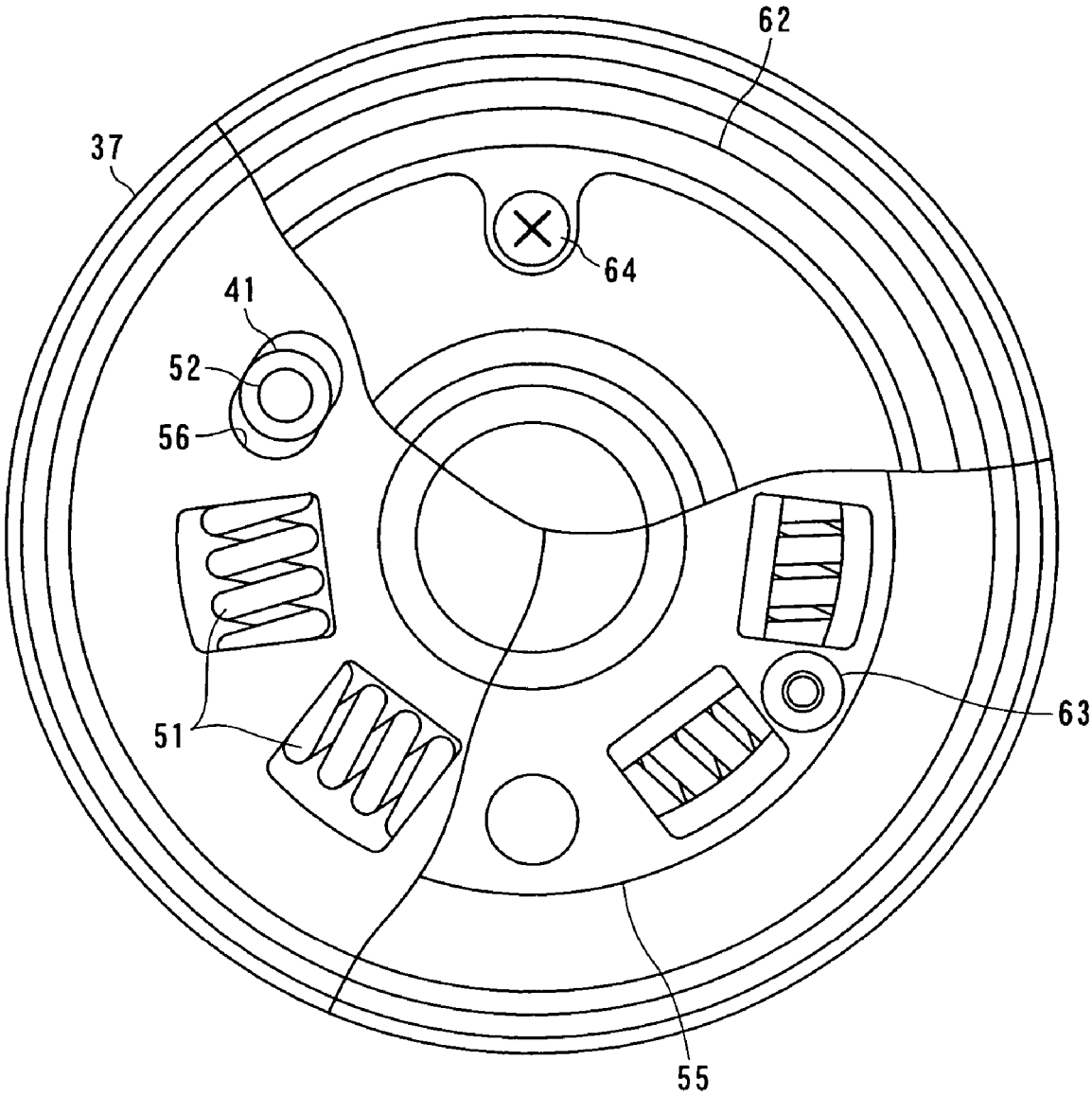
FIG. 5 is a sectional view taken along the line V—V in FIG. 4.

As shown also in FIG. 5, the clutch housing 41 is disposed on the right side surface of the primary driven gear 37 via a plurality of primary dampers 51 and a plurality of rivet pins 52 (both are described later) so as to be rotatable integrally with the primary driven gear 37. In FIG. 4, reference numeral 53 denotes a disk spring for eliminating a play between the primary dampers 51 and the clutch housing 41.

The drive plates 43 are incorporated into the inner peripheral portion of the clutch housing 41 so as to be rotatable integrally with the clutch housing 41 and so as to be movable along the axial direction thereof. On the other hand, the clutch hub 42 is fixed to the right end of the counter shaft 13 through the spline engagement and by using a lock nut 54 so as to be rotatable integrally with the counter shaft 13. The driven plates 44 are incorporated into the outer peripheral portion of the clutch hub 42 so as to be rotatable integrally with the clutch hub 42 and so as to be movable along the axial direction thereof.

The respective drive plates 43 and the respective driven plates 44 are alternately superimposed on each other, and all of the drive plates 43 and the driven plates 44 are pressed against the clutch hub side by means of the pressure plate 45, which is resiliently urged by the clutch spring 46. As a result, the friction forces occurring between the drive plates 43 and the driven plates 44 cause the clutch housing 41 and the clutch hub 42 to rotate integrally with each other, thereby transmitting the rotation of the crank shaft 2 to the counter shaft 13 and to the mechanisms or members downstream side thereof in the engine power transmission path.

When a clutch lever, not shown, is operated, the clutch release bar 48, the clutch release rod .49 and the clutch release piece 47 move the pressure plate 45 to the right side against the urging force of the clutch spring 46. As a consequence, the frictional engagement between the respective drive plates and driven plates is released from each other, thereby interrupting the rotation of the primary driven gear 37 with respect to the counter shaft 13.

A sliding plate 55 is applied to the left side surface of the primary driven gear 37, and a plurality of rivet pins 52 passes through the clutch housing 41, the primary driven gear 37 and the sliding plate 55 so that these three members can be rotated together. Further, since through-holes 56 for the rivet pins of the primary driven gear 37 are formed to each have an elongated hole shape extending along the peripheral direction of the primary driven gear 37, the clutch housing 41 and the sliding plate 55 can rotate by a small amount relative to the primary driven gear 37.

A plurality of primary dampers 51, each having a coil spring shape, are interposed in the clutch housing 41, the primary driven gear 37 and the sliding plate 55, across their thickness direction of the sliding plate 55. Since the primary driven gear 37 can rotate relative to the clutch housing 41 and the sliding plate 55, even if torque variations, e.g. rotational shocks, of the crank shaft 2 occur, the primary dampers 51 are each subjected to a shearing force and shrunk, thereby absorbing the torque variations. This prevents the rotational shocks from being transmitted to the counter shaft 13 and the mechanisms or members disposed downstream side thereof in the engine power transmission path.

Figure 2:
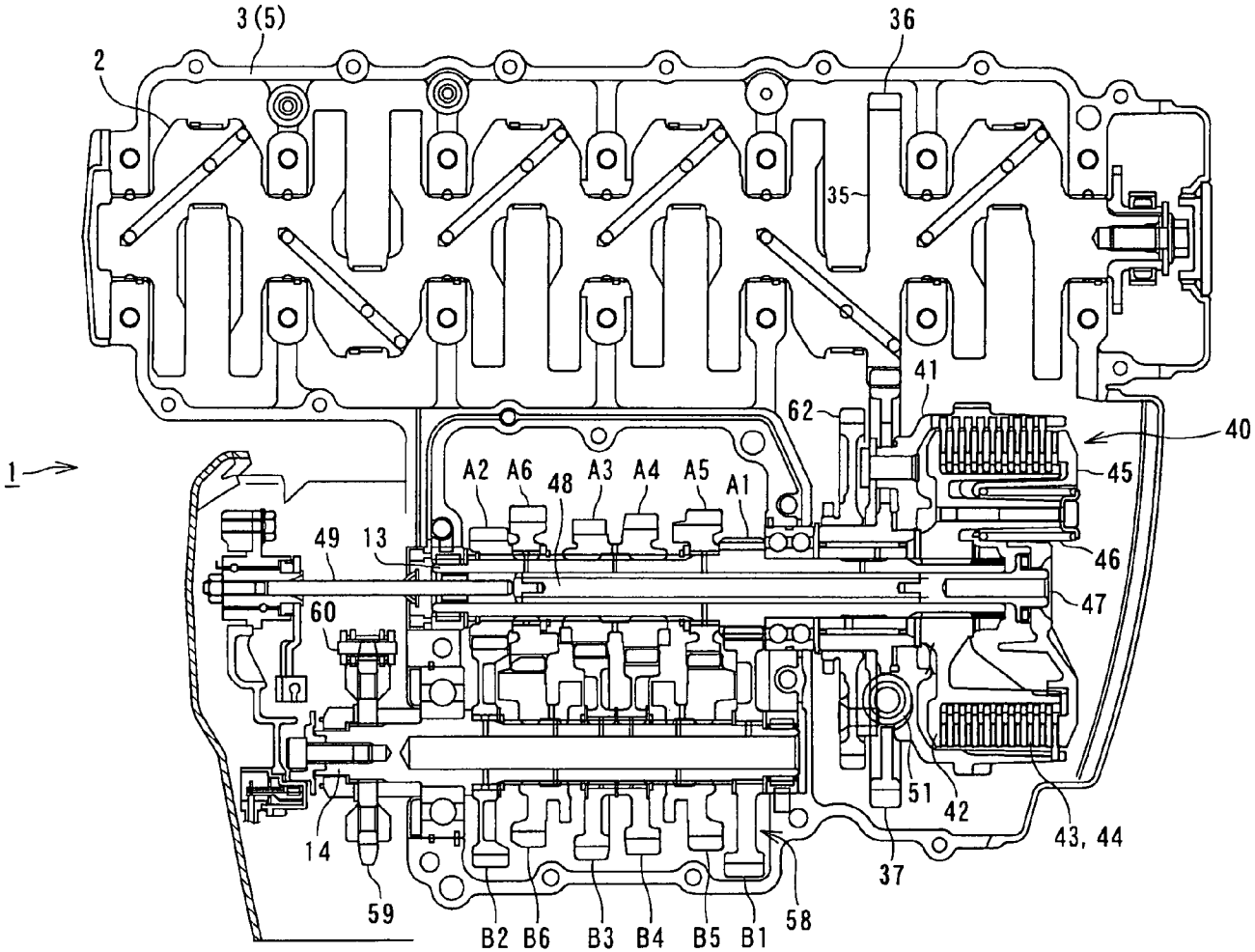
FIG. 2 is a sectional view of the engine unit taken along the line A-$O_1$-$O_2$-$O_3$-A in FIG. 1.

As shown in FIG. 2, the counter shaft 13 is mounted with a plurality of drive gears A1 to A6, and on the other hand, the drive shaft 14 is mounted with a plurality of driven gears B1 to B6. The drive gears A1 to A6 are always meshed with the corresponding driven gears B1 to B6, respectively, so as to constitute a six-stage speed change gear drive mechanism 58 together (in operative assosiation) with a shift mechanism, not shown. During the speed change operation of this speed change gear drive mechanism 58, the clutch mechanism 40 is disconnected to easily carry out the smooth speed change operation.

The left end of the drive shaft 14 projects out of the engine case 3, and a drive chain 60 is stretched between a drive sprocket 59 provided at this projection and a driven sprocket provided at the rear wheel of a motorcycle to thereby transmite the rotation of the drive shaft 14 to the rear wheel.

Further, an accessory drive gear 62 having a diameter, smaller in one stage, is disposed juxtaposedly with the primary driven gear 37 on the inside of the primary driven gear 37 in the width direction of the motorcycle body (i.e., toward the left side of the primary driven gear 37 in FIG. 2). This accessory drive gear 62 is securely fastened to a plurality of fastening bosses 63 formed on the left side surface of the sliding plate 55 with a plurality of fixing screws 64 so as to be rotatable integrally with the fastening bosses 63. The accessory drive gear 62 provided to such position is located downstream of the primary dampers 51 and upstream of the clutch mechanism 40, in the engine power transmission path.

As shown in FIGS. 1 and 3, an idle gear shaft 66 and an intermediate shaft 67 are journaled on the joint surface F2 between the engine upper case 4 and the engine top cover 6. These shafts 66 and 67 are disposed so as to extend in the front and rear direction in parallel with the crank shaft 2 and the counter shaft 13. A large-diameter idle driven gear 68 and a small-diameter idle driven gear 69 are rotatably supported on the idle gear shaft 66, and the intermediate shaft 67 are rotatably supported, at its both ends, by means of bearings 71 and 72.

The left end of the intermediate shaft 67 is connected to the main shaft 74 of a generator 32 via the accessory damper 73 so as to be rotateable integrally with the main shaft 74. The accessory damper 73 is constructed by bladed-wheel shaped damper receivers 75 and 76 and a rubber cushion 77. The damper receivers 75 and 76 are respectively provided at the left end of the intermediate shaft 67 and the right end of the main shaft 74, and the rubber cushion 77 is interposed between the damper receivers 75 and 76.

On the other hand, the accessory driven gear 79 mounted on the right end of the intermediate shaft 67 so as to be rotatable integrally with the intermediate shaft 67 is meshed with the accessory drive gear 62, and the generator 32 is driven by the drive gear 62. Elastic deformation of the rubber cushion 77 of the accessory damper 73 absorbs rotational shocks from the crank shaft 2 due to torque variations, thus protecting the generator 32 against the rotational shocks.

Furthermore, a one-way clutch 81 is mounted at an intermediate portion of the intermediate shaft 67, and a starter driven gear 82 is also mounted on the outer peripheral surface thereof. This starter driven gear 82 meshes with the idle drive gear 69, and on the other hand, the idle driven gear 68 meshes with a pinion gear 84 formed on the main shaft 83 of the starter motor 31. That is, the starter motor 31 is gear-engaged with the intermediate shaft 67 via the one-way clutch 81 at a portion between the accessory damper 73 and the accessory driven gear 79.

At the startup of the starter motor 31, the one-way clutch 81 comes into a connected state, and the driving force of the starter motor 31 is transmitted to the crank shaft 2 through the one-way clutch 81, the accessory driven gear 79 and the accessory drive gear 62, thereby starting up the engine unit 1. After the startup of the engine, the one-way clutch 81 comes into a disconnected state and does not transmit the rotation of the intermediate shaft 67 to the starter motor, whereby the starter motor 31 is prevented from being reversely driven.

In the engine unit 1 of the structures mentioned above, since the accessory drive gear 62 is disposed downstream side of the primary dampers 51 in the engine power transmission path, the primary dampers 51 are positioned between the crank shaft 2 and the starter motor 31 and generator 32. The buffering effect produced by this positioning, i.e., intervention, of the primary dampers 51 reduces gear noises due to backlashes of a gear train comprising a plurality of gears 62, 68, 69, 79, 82 and 84, and enhances the durability of the generator 32 and the like.

Furthermore, in the engine unit 1 according to the present invention, the accessory drive gear 62 is disposed upstream side of the clutch mechanism 40 in the engine power transmission path, and therefore, by disengaging the clutch connection of the clutch mechanism 40 at the startup of the engine, it is possible to reduce the rotational inertia mass and improve the startup performance of the engine without causing the starter motor 31 to drive the speed change gear drive mechanism 58.

Still furthermore, in the engine unit 1 according to the present invention, the generator 32 is connected to the intermediate shaft 67 so as to be rotatable integrally with the intermediate shaft 67. The accessory driven gear 79 is provided to be meshed with the accessory drive gear 62. The the accessory damper 73 is also disposed between the intermediate shaft 67 and the generator 32. Moreover, the starter motor 31 is engaged with the intermediate shaft 67 via the one-way clutch 81 so that the position of this gear engagement is made between the accessory damper 73 and the accessory driven gear 79. Accordiing to the above structures and/or arrangement, the accessory damper 73 can be protected against torque variations of the engine, and in addition, since the generator 32 is driven through the accessory damper 73, it is possible to reduce noises of the generator 32 and increase the durability thereof. Furthermore, since the accessory damper 73 is only subjected to a rotational mass of the generator 32, the durability of the accessory damper 73 can be improved and/or the size thereof can be made compact, thus being advantageous.

Still furthermore, according to the the engine unit 1 of the present invention, since the accessory damper 73 is disposed so as to face the coupling portion between the intermediate shaft 67 and the generator 32, the accessory damper 73 can be easily replaced only by dismounting the generator 32, which contributes to the improved maintainability.

Still furthermore, since the clutch mechanism 40 is disposed further toward outside than the primary driven gear 37 in the width direction of the motorcycle, and the accessory drive gear 62 is disposed further toward the inside than the primary driven gear 37 in the width direction thereof, the accessory drive gear 62 and the accessory driven gear 79 are meshed at a position closer to the center side of the engine in the width direction of the motorcycle. As a result, the installation positions of the generator 32, the starter motor 31 and the like also become closer to the center side in the width direction of the motorcycle. This allows the lateral weight balance of the engine unit 1 to be adjusted.

Consequently, as mentioned hereinabove, according to the present invention, it is possible to reduce the gear noises due to backlashes of the gear train including the accessory drive gear, enhance the durability of the accessories, i.e., auxiliary equipments or elements of the engine and, in addition, improve the startup performance, the maintainability, and the lateral weight balance of the engine.

What is claimed is:

1. An engine unit of a motorcycle, comprising:

a crank shaft and a counter shaft which are journaled in parallel with each other;

a primary drive gear provided on the crank shaft;

a primary driven gear provided on the counter shaft so as to be meshed with the primary drive gear;

primary dampers provided to the primary driven gear for absorbing rotational shocks;

a clutch mechanism provided to the primary driven gear for transmitting rotation of the primary driven gear to the counter shaft and interrupting the rotation therefrom; and an accessory drive gear which is disposed juxtaposedly with the primary driven gear for driving an accessory and through which a driving force of a starter motor is transmitted to the crank shaft, wherein said accessory drive gear is disposed on a downstream side of the primary dampers in an engine power transmission path.

2. An engine unit of a motorcycle according to claim 1, wherein said accessory drive gear is disposed on an upstream side of the clutch mechanism in the engine power transmission path.

3. An engine unit of a motorcycle according to claim 1, further comprising: an intermediate shaft which is disposed in parallel with the crank shaft and the counter shaft and to which the accessory is connected to be rotateable integrally therewith; an accessory driven gear meshed with the accessory drive gear; and an accessory damper provided between the intermediate shaft and the accessory for absorbing rotational shocks, wherein the starter motor is engaged with the intermediate shaft, through a gear engagement, via a one-way clutch, and the gear engagement is made at a portion between locations of the accessory damper and the accessory driven gear.

4. An engine unit of a motorcycle according to claim 3, wherein said accessory damper is disposed so as to face the coupling portion between the intermediate shaft and the accessory.

5. An engine unit of a motorcycle according to claim 1, wherein said clutch mechanism is disposed further outside of the primary driven gear in the width direction of the motorcycle and, on the other hand, the accessory drive gear is disposed further inside of the primary driven gear in the width direction of the motorcycle.

6. An engine unit of a motorcycle according to claim 1, wherein said accessory includes a generator driven by the accessory drive gear.

* * * * *